US007350525B2

(12) United States Patent
Delage

(10) Patent No.: US 7,350,525 B2
(45) Date of Patent: Apr. 1, 2008

(54) DEVICE FOR PACKAGING AND APPLYING A SUBSTANCE SUCH AS A COSMETIC OR ANOTHER CARE PRODUCT

(75) Inventor: Jean-François Delage, Clamart (FR)

(73) Assignee: L'Oreal, Paris (FR)

( * ) Notice: Subject to any disclaimer, the term of this patent is extended or adjusted under 35 U.S.C. 154(b) by 358 days.

(21) Appl. No.: 10/849,144

(22) Filed: May 20, 2004

(65) Prior Publication Data

US 2004/0237994 A1 Dec. 2, 2004

Related U.S. Application Data

(60) Provisional application No. 60/477,749, filed on Jun. 12, 2003.

(30) Foreign Application Priority Data

May 21, 2003 (FR) ..... 03 06120

(51) Int. Cl.
*A45D 33/00* (2006.01)

(52) U.S. Cl. ..... 132/293

(58) Field of Classification Search ..... 132/304, 132/293–303, 305; 206/823, 581
See application file for complete search history.

(56) References Cited

U.S. PATENT DOCUMENTS

| | | | | |
|---|---|---|---|---|
| 2,625,262 | A * | 1/1953 | Pinkas | 221/137 |
| 3,586,010 | A * | 6/1971 | Landen et al. | 132/287 |
| 4,579,133 | A | 4/1986 | Seidler | |
| 5,180,084 | A * | 1/1993 | Favre | 222/192 |
| 5,836,319 | A | 11/1998 | Lombardi | |
| 5,845,658 | A * | 12/1998 | Sussman | 132/287 |
| 6,378,533 | B1 | 4/2002 | Roman | |
| 6,540,083 | B2 | 4/2003 | Shih | |
| 6,745,900 | B2 * | 6/2004 | Lambert | 206/581 |
| 6,978,790 | B2 * | 12/2005 | Byun | 132/287 |
| 7,021,318 | B2 * | 4/2006 | Byun | 132/294 |
| 7,140,372 | B2 * | 11/2006 | Byun | 132/287 |

FOREIGN PATENT DOCUMENTS

| | | |
|---|---|---|
| EP | 1 277 418 A1 | 1/2003 |
| GB | 1 212 209 | 11/1970 |
| JP | U-54-165235 | 11/1979 |
| JP | U-60-147306 | 9/1985 |
| JP | U-61-184512 | 11/1986 |
| JP | U-63-171103 | 11/1988 |
| JP | U-4-10726 | 1/1992 |

* cited by examiner

*Primary Examiner*—Robyn Doan
(74) *Attorney, Agent, or Firm*—Oliff & Berridge PLC

(57) ABSTRACT

A device for applying a substance includes: a body that defines a housing having a bottom; an applicator arranged to be received in the housing and to rest at least in part on the bottom thereof; and a housing closure member movable relative to the body between an open position that allows access to the applicator, and a closed position that prevents access to the applicator. The closure member includes a portion arranged to push the applicator at least in part out from the housing when the closure member passes from the closed position to the open position.

28 Claims, 3 Drawing Sheets

DEVICE FOR PACKAGING AND APPLYING A SUBSTANCE SUCH AS A COSMETIC OR ANOTHER CARE PRODUCT

This application claims the benefit of French Application No. 03 06120 filed on May 21, 2003 and U.S. Provisional Application No. 60/477,749 filed on Jun. 12, 2003, the entire disclosures of which are incorporated by reference herein.

FIELD OF INVENTION

The present invention relates to devices for applying substances, such as cosmetics or other care products, such a device comprising a body defining a housing and an applicator arranged to be received in the housing when not in use.

BACKGROUND

U.S. Pat. No. 5,836,319 describes a powder compact comprising a body and a drawer that moves relative to the body and serves to contain an applicator constituted by a powder puff. In a bottom thereof, the drawer has a mirror on which the applicator rests. Such a device has the particular drawback that the applicator is liable to leave powder on the mirror. In addition, the drawer can become completely separated from the body of the compact, which can impede use thereof under certain circumstances.

European patent application No. 1,277,418 discloses a packaging and dispenser device including a screen through which the substance is taken. In one example, the applicator is housed above the screen and is thus stored in a hermetically closed environment, thereby making it possible to prevent the applicator from drying out between two applications.

British patent No. 1,212,209 discloses a device having a plurality of compartments that are hinged relative to one another. No provision is made for housing an applicator.

U.S. Pat. No. 6,540,083 describes a device which, like the subject matter of the foregoing British patent, does not include an applicator.

U.S. Pat. No. 6,378,533 relates to a powder compact including a pivoting drawer in which an applicator is housed. A mirror is carried by a lid for closing a housing that contains the substance.

SUMMARY OF THE INVENTION

Exemplary embodiments of the invention provide a novel device which, for example, is practical to use, occupies little space, is reliable in operation, and/or is relatively simple and inexpensive to manufacture.

Exemplary embodiments of the invention provide a device for applying a substance, the device comprising: a body that defines a housing having a bottom; an applicator arranged to be received in the housing and to rest at least in part on the bottom thereof; and a housing closure member movable relative to the body between an open position that allows access to the applicator, and a closed position that prevents access to the applicator, said closure member comprising a portion arranged to push the applicator at least in part out from the housing when the closure member passes from the closed position to the open position. In exemplary embodiments, the applicator may be pushed out from the housing by a portion of the closure member which moves in the housing when the closure member goes from the closed position to the open position.

Exemplary embodiments of the invention, such as described above, make it easier to take hold of the applicator when the closure member is in the open position.

Exemplary embodiments of the invention provide a device for applying a substance, the device comprising: a body that defines a housing; an applicator arranged to be received in the housing; and a mirror that is movable relative to the body and is arranged to enter into the housing, said mirror having a reflecting face that faces away from the applicator when the mirror is entered into the housing.

In exemplary embodiments of the invention, such as described above, the reflecting face of the mirror does not come into contact with the applicator, and is therefore not likely to be dirtied by the applicator.

In exemplary embodiments, the mirror may be carried by a member for closing the housing that contains the applicator.

In exemplary embodiments of the invention, it is also possible to reduce the risk of substance being spattered onto the mirror by retracting the mirror into a housing that is not designed to receive the substance, unlike devices in which the mirror is fixed to an inside face of a lid for closing the compact and thus faces the supply of substance.

In exemplary embodiments, the closure member may be advantageously hinged to the body, for example, ensuring that the closure member is held captive thereby.

In exemplary embodiments, the mirror may be fixed to the closure member, with the reflecting face of the mirror facing upward when the device is in an in-use position. In exemplary embodiments, the closure member may include a setback, for example, of a circularly cylindrical shape, in which the mirror is secured.

In exemplary embodiments, the closure member may include a side wall which is arranged so as to define a portion of an outside surface of the device when the closure member is in the closed position. Such a side wall may extend over only a fraction of a circumference of the closure member, leaving a passage through which the applicator can pass at least in part when the closure member is moved from the open position to the closed position.

In exemplary embodiments, the portion of the closure member which serves to push the applicator out from the housing when the closure member is moved from the closed position to the open position may be constituted, for example, by one end of the side wall, said one end possibly being situated, for example, substantially opposite a bearing surface for a user relative to an axis about which the closure member can pivot, thereby enabling the user to move the closure member from the closed position to the open position. For example, the bearing surface may be defined by at least one step in the side wall.

In exemplary embodiments, the closure member may advantageously include at least one portion in relief arranged to snap-fasten with the body when the closure member is in the closed position. This portion in relief may be constituted, for example, by a projection on the side wall.

In exemplary embodiments, the closure member may include an inside partition arranged to reduce the ability of the applicator to move inside the housing when the closure member is in the closed position. This inside partition may, for example, be of a shape that matches substantially a shape of a fraction of an outline of the applicator when the closure member is in the closed position. For example, the shape may be substantially arcuate in a plane perpendicular to an axis of rotation of the closure member.

In exemplary embodiments, the side wall of the closure member may be connected to a top wall which may serve, where appropriate, to support the mirror. Said top wall may possibly extend generally perpendicularly to the pivot axis of the closure member when the closure member is hinged to the body of the device. The side wall and the top wall may be made integrally, i.e., monolithically, by molding a plastics material, for example, together with projections that serve to pivot the closure member when the closure member is fixed in a hinged manner to the body of the device.

In exemplary embodiments, the closure member need not have a bottom wall facing the top wall, so that the applicator can rest on the bottom of the housing. The body of the applicator device may include, for example, on a top portion thereof, a portion in relief that enables the device to be assembled with a device for packaging a substance. For example, the substance may be a cosmetic, such as rouge or foundation makeup such that the assembled devices form a conditioning and applicator assembly.

In exemplary embodiments, the applicator device may be fixed, for example, to a part of the packaging device which defines a bottom of a housing containing the substance. The substance may be contained directly in the housing or may be contained in a cup disposed in the housing.

In exemplary embodiments, in addition to the portion in relief for engaging the packaging device, the applicator device may further include at least one portion in relief for preventing rotation so as to prevent the applicator device from turning relative to the packaging device.

In exemplary embodiments, the applicator may be constituted by a powder puff. For example, the powder puff may comprise foam, or even possibly flocked foam.

In exemplary embodiments, the packaging device may include a lid for closing a housing that contains the substance. Said lid may possibly be arranged to be screwed on, or to pivot about a hinge.

Exemplary embodiments of the invention provide a packaging and applicator assembly comprising an applicator device as described above together with a packaging device on which the applicator device is fixed, for example, in a releasable manner.

Exemplary embodiments of the invention provide a method of preparing makeup, comprising selecting a packaging device from a plurality of packaging devices and assembling the selected packaging device with an applicator device as described above. For example, a user may select a substance having a particular color and may associate said substance with the applicator device, which can subsequently be reused with some other substance.

BRIEF DESCRIPTION OF THE DRAWINGS

The invention will be better understood on reading the following detailed description of non-limiting embodiments thereof, and on examining the accompanying drawings, in which.

DETAILED DESCRIPTION OF EXEMPLARY EMBODIMENTS

The term "care products" is used to generically refer to any substance that is used to effect one or more external body conditions, such as conditions of the skin, hair and nails. For example, such substances include, but are not limited to, treatment products, such as sunscreen, moisturizer and/or medicaments, cleansing products and cosmetic products, such as makeup products, or any other known or later developed product that may be applied to the body.

FIGS. 1 to 4 show a packaging and applicator assembly 10 comprising a packaging device 11 and an applicator device 12 which are assembled to each other, the assembly 10 possibly being releasable, as is the case in the first exemplary embodiment shown.

Figure 5:
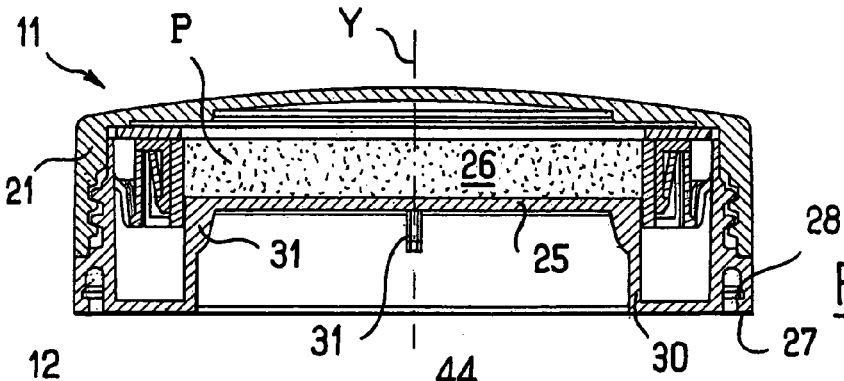
FIG. 5 is a cross-section view of the packaging device of the assembly of FIG. 2, shown in isolation.
Figure 6:
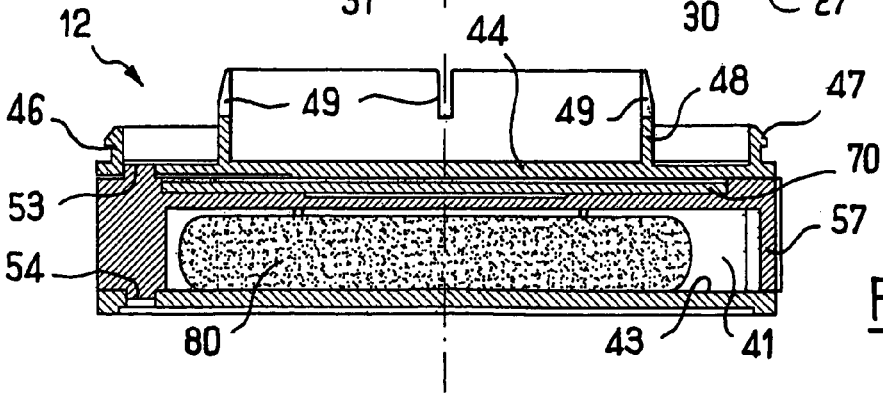
FIG. 6 is a cross-section view of the applicator device of the assembly of FIG. 2, shown in isolation.

The packaging device 11 is shown in isolation in FIG. 5, whereas the applicator device 12 is shown in isolation in FIG. 6.

The packaging device 11 comprises a base 20, a lid 21 arranged to be screwed onto the base 20, and a screen 23 carried by a ring 24 suitable for moving relative to the base 20 along an axis Y. The ring 24 co-operates with a wall 25 of the base 20 that extends transversely to the axis Y to define a housing 26 suitable for containing a substance P for application. As shown, the housing 26 is closed on top by the screen 23. The ring 24 can move downward as substance is taken from the housing 26. A device with a moving screen that is similar to that shown in FIG. 5 is described in the above-mentioned European patent application No. 1,277,418 A1 in the name of the Applicant, the entire disclosure of which is incorporated herein by reference.

In a bottom portion and at a periphery thereof, the base 20 includes an outside skirt 27 having a groove 28 on a radially inside face thereof. The groove 28 serves a function that is described below.

The base 20 also has an inside skirt 30, concentric with the outside skirt 27, connected on top to the transverse wall 25, and having at least one projection 31 formed on a radially inside surface thereof. The purpose of the at least one projection 31 is likewise explained in greater detail below. In the first exemplary embodiment, there are four projections 31 uniformly distributed angularly about the axis Y.

The applicator device 12 comprises a body 40 that defines a housing 41 for receiving an applicator 80, and a closure member 50 hinged to the body 40 about a pivot axis X. The pivot axis X is parallel to the axis Y of the packaging device 11, in the first exemplary embodiment, once the packaging and applicator devices 11 and 12 have been assembled together.

The body 40 has a bottom wall 42 with a top face 43 that defines a bottom of the housing 41. In a storage position, the applicator 80 has a bottom face thereof resting entirely against the top face 43, for example, as shown in the first exemplary embodiment.

Figure 9:
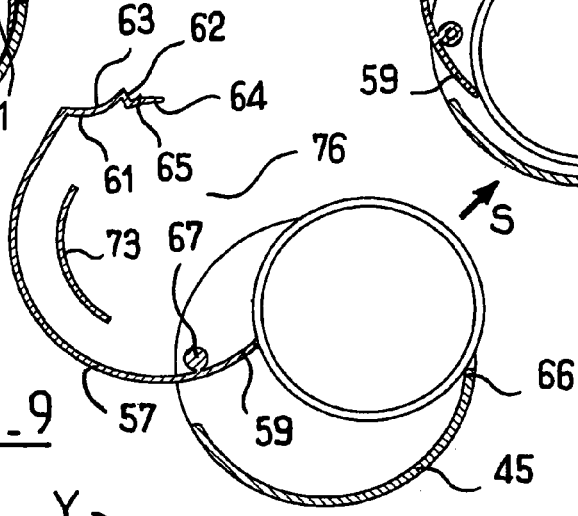
Figure 8:
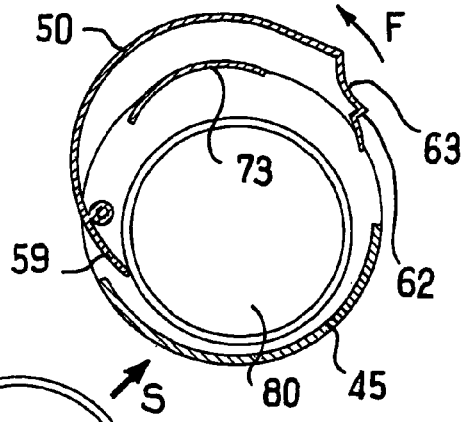

The body 40 also has a top wall 44 which is parallel to the bottom wall 42 and which is connected thereto by a side wall 45 that extends, for example, around the axis Y over an angular sector that is slightly smaller than 180°, as shown in the first exemplary embodiment, in particular in FIGS. 8 and 9.

A tubular skirt 46 is connected at a bottom thereof to the top wall 44. The skirt 46 is provided at a periphery thereof with a bead 47 arranged to snap into the groove 28 of the packaging device 11, so as to hold the packaging and applicator devices 11 and 12 together when assembled.

A second tubular skirt 48, concentric with and disposed inside the first tubular skirt 46, is also connected at a bottom end thereof to the top wall 44. The second tubular skirt 48 is arranged to engage inside the inside skirt 30 of the packaging device 11 and includes notches 49 into which the projections 31 can be engaged, so that the applicator device 12 is prevented from turning relative to the packaging device 11 when assembled.

The top and bottom walls 44 and 42 include recesses 51 and 52 along the axis X in which respective projections 53 and 54 carried on a pin 67 of the closure member 50 can engage so as to hinge the closure member 50 relative to the body 40.

Figure 1:
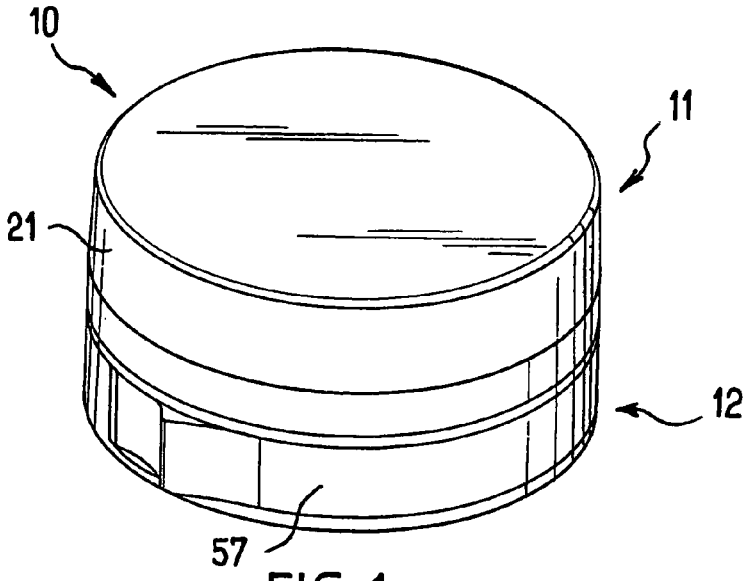
FIG. 1 is a diagrammatic perspective view of a packaging and applicator assembly according to a first exemplary embodiment of the invention.
Figure 2:
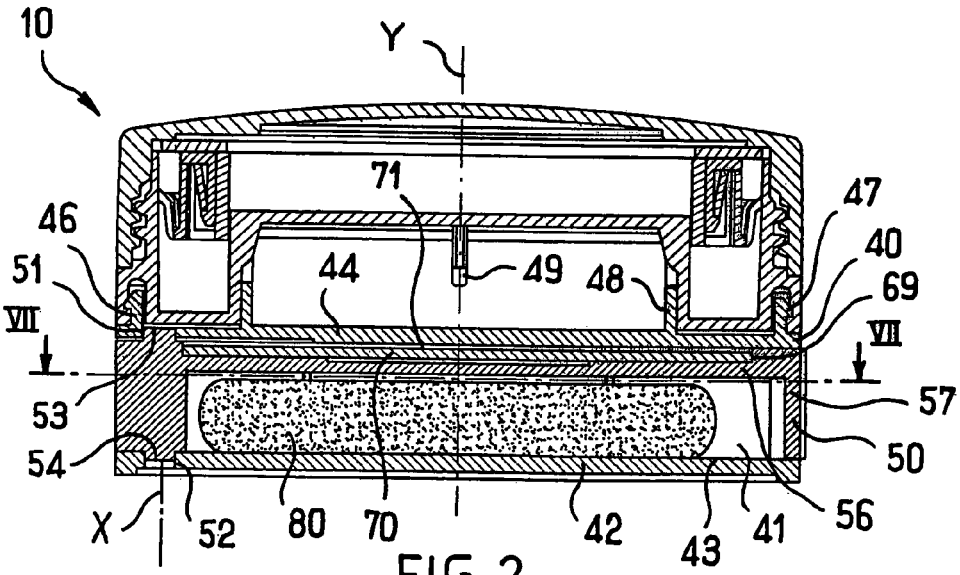
FIG. 2 is a diagrammatic axial section view of the assembly of FIG. 1.

The closure member 50 has a top wall 56 which extends perpendicularly to the axis X. The top wall 56 is connected to a top of a side wall 57 which, when the closure member 50 is in the closed position as shown in FIG. 1, serves to define a portion of the outside surface of the assembly 10.

The top and side walls 56 and 57, in the first exemplary embodiment, are made integrally, i.e., monolithically, with the pin 67 and the projections 53 and 54, for example, by molding a plastics material.

The side wall 57 extends substantially along a circular arc, as shown in FIGS. 8 and 9, having a first end portion 59 and a second end portion 61. The second end portion 61 includes a step 62 and a setback 63 that enable a user to move the closure member 50 between the closed and open positions.

As shown in FIG. 9, the second end portion 61 is terminated by a tongue 64 provided with a tooth 65 arranged to snap against a corresponding portion in relief 66 on an inside face of the side wall 45 of the body 40, whenever the closure member 50 is in the closed position.

The top wall 56 has a housing 69 which opens on a top face thereof and which receives a mirror 70 whose reflecting face 71 faces upward, i.e., away from the applicator 80. The mirror 70 takes up a position immediately beneath the top wall 44 of the body 40 when the closure member 50 is in the closed position.

The closure member 50 also comprises an inside partition 73 made integrally, i.e., monolithically, with the top wall 56 in the first exemplary embodiment.

Figure 7:
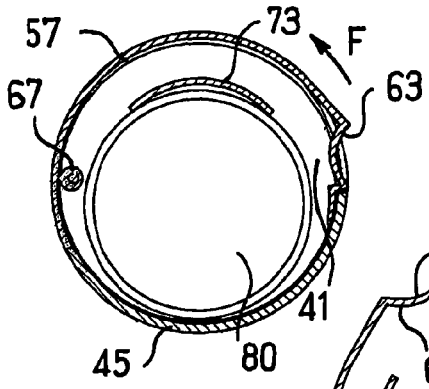
FIGS. 7 to 9 are diagrammatic and fragmentary cross section views taken along VII-VII of FIG. 2 illustrating how the applicator moves when the closure member goes from the closed position to the open position.

The inside partition 73 is generally circularly arcuate in shape, concentric with the side wall 57, and arranged to bear against the applicator 80 when the closure member 50 is in the closed position, as shown in FIG. 7, so as to prevent the applicator 80 from moving in the housing 41.

As the closure member 50 does not have a bottom wall, the applicator 80 can rest directly against the bottom wall 42 of the body 40. A passage 76 is defined between the end portions 59 and 61 of the side wall 57.

The assembly 10 can be used as follows.

It is assumed that the closure member 50 is initially in the closed position, as shown in FIGS. 1 and 7, for example.

The user unscrews the lid 21, thereby allowing access to the substance P contained in the housing 26.

Thereafter, the user causes the closure member 50 to pivot toward the open position by moving the closure member 50 along arrow F shown in FIGS. 7 and 8. As the closure member 50 pivots, the closure member 50 presses via an edge of the second end portion 59 against the applicator 80 so that the applicator is pushed toward the opening of the housing along arrow S, as shown in FIG. 9, the applicator 80 sliding on the bottom 43.

Figure 3:
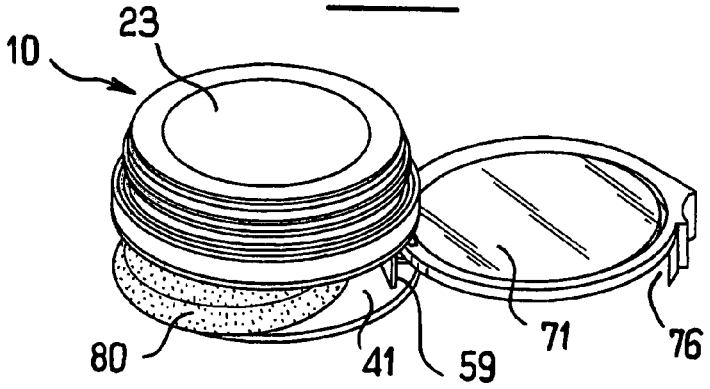
FIG. 3 is a diagrammatic perspective view of the assembly of FIG. 1 after the closure lid has been removed and after the housing that contains the applicator has been opened.
Figure 4:
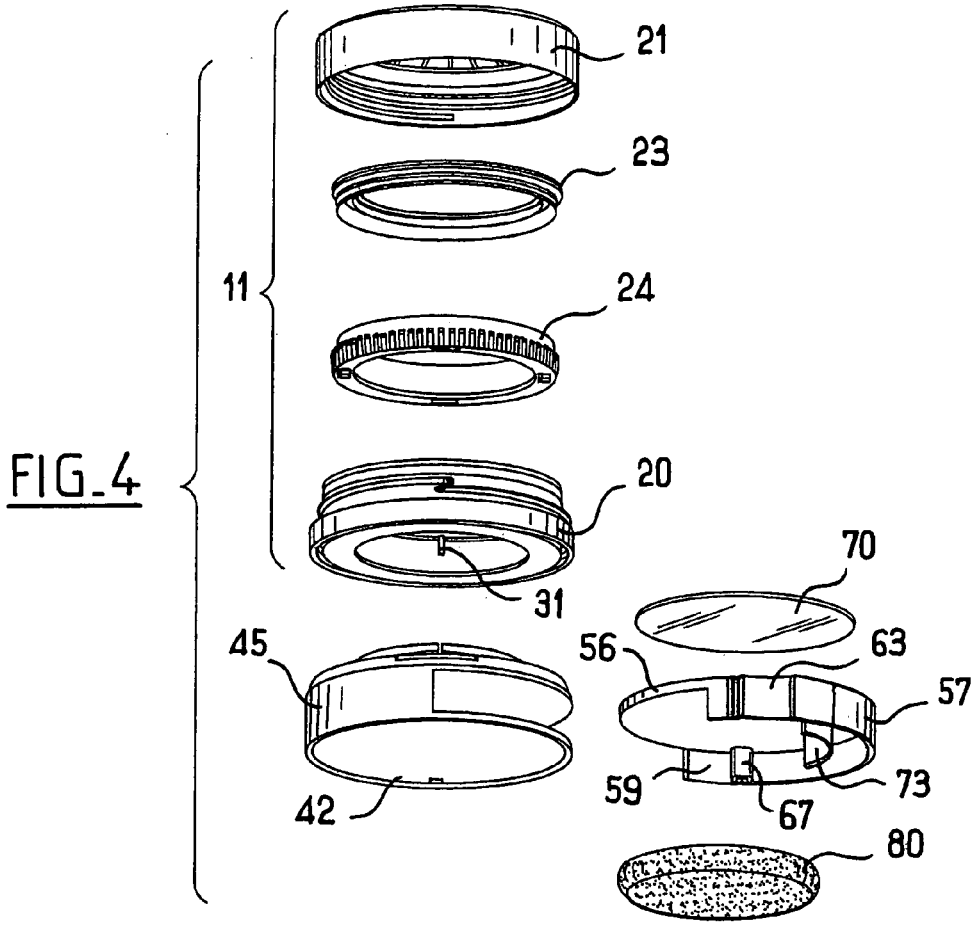
FIG. 4 is an exploded perspective view of the assembly of FIGS. 1 to 3.

Once the closure member 50 has reached the open position, as shown in FIG. 9, the applicator 80 projects slightly beyond the bottom wall 42, as shown in FIG. 3, thus making it easier for the user to take hold of the applicator 80. The reflecting face 71 of the mirror 70 is disengaged and the user can make use thereof to monitor application of the substance P by the applicator 80.

After use, the user can replace the applicator 80 in the housing 41 and can close the housing 41 by causing the closure member 50 to pivot in a direction opposite to arrow F.

In storage, the reflecting face 71 of the mirror 70 is isolated from the applicator 80 by the top wall 56, and is therefore not likely to be dirtied by the applicator 80.

In addition, in the first exemplary embodiment, the applicator 80 is stored in the housing 41 in a non-sealed manner, given that the closure thereof is not hermetic. Thus, the applicator 80 can dry out if the applicator 80 has, for example, inadvertently received a splash of liquid during making up. This makes it possible to reduce the risk of bacteria proliferating.

Naturally, the invention is not limited to the exemplary embodiment described above. For example, the packaging device 11 and/or the applicator device 12 could be made differently.

Figure 10:
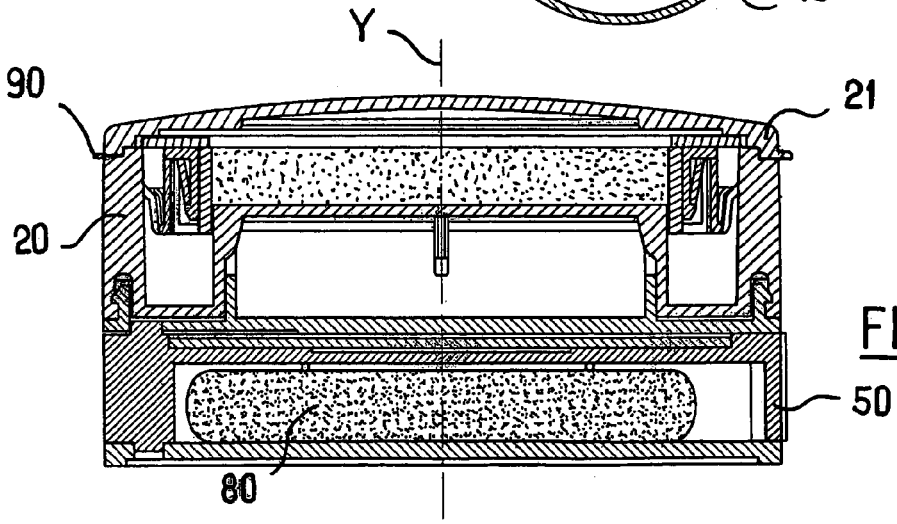
FIGS. 10 and 11 are diagrammatic axial section views analogous to FIG. 2, illustrating a packaging and applicator assembly according to second and third exemplary embodiments of the invention, respectively.

In a second exemplary embodiment shown in FIG. 10, the packaging device is made with a lid 21 which is connected to the base 20 via a hinge 90. The hinge 90 may be constituted, for example, by a film hinge.

Figure 11:
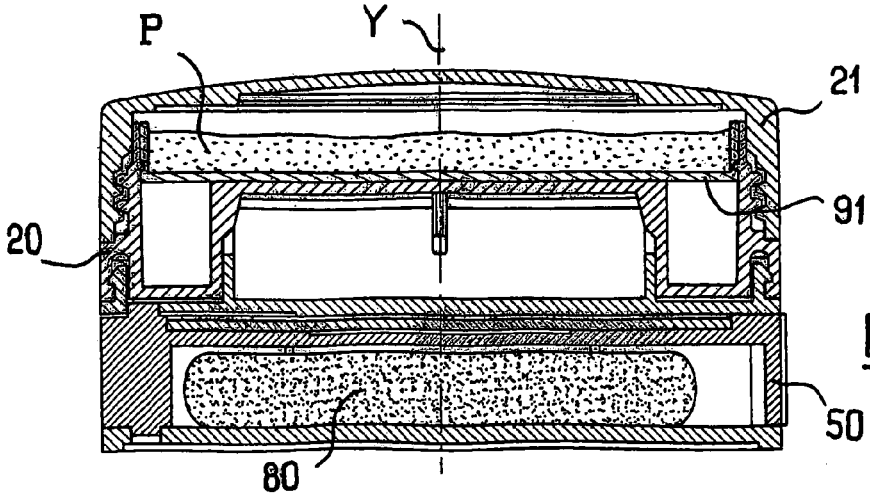

In a third exemplary embodiment shown in FIG. 11, the substance P is contained in a cup 91 and access to the substance P does not take place through a screen.

Throughout the description, including in the claims, the term "comprising a" should be understood as being synonymous with "comprising at least one", unless specified to the contrary.

Although the present invention herein has been described with reference to particular embodiments, it is to be understood that these embodiments are merely illustrative of the principles and applications of the present invention. It is therefore to be understood that numerous modifications may be made to the illustrative embodiments and that other arrangements may be devised without departing from the spirit and scope of the present invention.

What is claimed is:

1. A device for applying a substance, the device comprising:

a body that defines a housing having a bottom;

an applicator arranged to be received in the housing and to rest at least in part on the bottom thereof; and a housing closure member movable relative to the body between an open position that allows access to the applicator, and a closed position that prevents access to the applicator, said closure member comprising a portion arranged to push the applicator at least in part out from the housing when the closure member passes from the closed position to the open position.

2. A device according to claim 1, further comprising a mirror that is movable relative to the body, the mirror being arranged to enter into the housing, said mirror having a reflecting face that faces away from the applicator when the mirror is entered into the housing.

3. A device according to claim 1, wherein the closure member is hinged to the body.

4. A device according to claim 2, wherein the mirror is fixed to the closure member.

5. A device according to claim 1, wherein the closure member includes a side wall which is arranged in such a manner as to define a portion of the outside surface of the device when the closure member is in the closed position.

6. A device according to claim 5, wherein the portion of the closure member which is used for pushing the applicator out from the housing when the closure member passes from the closed position to the open position comprises an end of the side wall.

7. A device according to claim 6, wherein the end of the side wall is situated on a side of an axis about which the closure member pivots that is opposite from a bearing surface that enables the user to move the closure member from the closed position to the open position.

8. A device according to claim 1, wherein the closure member includes at least one portion in relief arranged to snap onto the body when the closure member is in the closed position.

9. A device according to claim 1, wherein the closure member includes an inside partition arranged to reduce the ability of the applicator to move inside the housing when the closure member is in the closed position.

10. A device according to claim 9, wherein the inside partition has a shape substantially matching a shape of a portion of an outline of the applicator when the closure member is in the closed position.

11. A device according to claim 5, wherein the side wall is connected to a top wall that supports a mirror, said top wall extending generally perpendicularly to a pivot axis of the closure member when the closure member is hinged to the body of the device.

12. A device according to claim 11, wherein the side wall and the top wall are made integrally by molding a plastics material.

13. A device according to claim 12, wherein the side wall and the top wall are made integrally by molding a plastics material together with projections that serve as pivots for the closure member when the closure member is secured in a hinged manner to the body of the device.

14. A device according to claim 11, wherein the closure member does not have a bottom wall facing the top wall, so that the applicator can rest on the bottom of the housing.

15. A device according to claim 1, wherein the body of the applicator device includes a portion in relief that enables the applicator device to be assembled with a device for packaging a substance.

16. A device according to claim 1, wherein the body of the applicator device includes, on a top portion thereof, a portion in relief that enables the applicator device to be assembled with a device for packaging a substance.

17. A device according to claim 15, wherein the applicator device is secured to a portion of the packaging device which defines a bottom of a housing containing the substance.

18. A device according to claim 15, further comprising at least one additional portion in relief for preventing rotation that prevents the applicator device from turning relative to the packaging device.

19. A device according to claim 1, wherein the applicator comprises a powder puff.

20. A device according to claim 15, wherein the packaging device comprises a lid for closing a housing containing the substance.

21. A packaging and applicator assembly comprising an applicator device according to claim 1 together with a packaging device to which the applicator device is secured.

22. A packaging and applicator assembly according to claim 21, wherein the applicator device is releasably secured to the packaging device.

23. A method of preparing makeup, the method comprising:

selecting a packaging device from a plurality of packaging devices, and assembling the selected packaging device with an applicator device according to claim 1.

24. A device according to claim 10, wherein the shape is substantially circularly arcuate in a plane perpendicular to a pivot axis of the closure member.

25. A packaging and applicator assembly according to claim 21, wherein the packaging device contains a cosmetic.

26. A packaging and applicator assembly according to claim 21, wherein the packaging device contains a care product.

27. A method according to claim 23, wherein the packaging devices contain cosmetics.

28. A method according to claim 23, wherein the packaging devices contain care products.

* * * * *